United States Patent [19]

Stierlein

[11] 4,021,896

[45] May 10, 1977

[54] DEVICES FOR TYING A LAYER OF THREADS OR SLIVERS

[75] Inventor: Gerard Stierlein, Mulhouse-Bourtzwiller, France

[73] Assignee: Societe Alsacienne de Constructions Mecaniques de Mulhouse, Mulhouse, France

[22] Filed: Sept. 8, 1976

[21] Appl. No.: 721,586

[30] Foreign Application Priority Data

Sept. 11, 1975 France ..... 75.27834

[52] U.S. Cl. ..... 28/1 R; 28/21; 28/40; 112/171

[51] Int. Cl.[2] ..... B65H 54/62

[58] Field of Search ..... 28/21, 1 R, 40, 72 SP, 28/198, 199, 291; 289/2, 18; 112/121.22, 170, 171

[56] References Cited

UNITED STATES PATENTS

| | | | |
|---|---|---|---|
| 2,662,496 | 12/1953 | Pedersen | 112/171 |
| 3,351,102 | 11/1967 | Logan et al. | 112/171 X |
| 3,869,769 | 3/1975 | Tanno | 28/21 |
| 3,927,446 | 12/1975 | Baba | 28/21 |

*Primary Examiner*—Louis K. Rimrodt

[57] ABSTRACT

The shuttle of the tying device is of magnetic metal, at least at its extremities. Each extremity of two arms is fitted with an electromagnet for temporarily receiving and retaining the corresponding extremity of the shuttle. The electromagnets are energized in alternate sequence through circuits comprising switches which are actuated in synchronism with the forward and backward movements of the arms by means of stationary contact-studs.

3 Claims, 11 Drawing Figures

1
2
3
5
6
11-1
11-2
11-3
11-4
11-5
15
16

DEVICES FOR TYING A LAYER OF THREADS OR SLIVERS

This invention relates to devices for tying a layer of threads or slivers of the type described and illustrated in French patent No. 70 27 162 granted to the present Applicant. These devices are primarily applicable to the tying of hanks of textile threads on an automatic reeling frame having independent and movable heads.

A device of this type essentially comprises two arms in which the arm extremities are capable of moving in the same plane on each side of the layer of threads to be tied while undergoing at the same time on the one hand a periodic movement towards and away from each other and, on the other hand, a forward movement followed by a movement of withdrawal, a shuttle provided with means for gripping the extremity of a tying thread supplied from a reserve bobbin carried by the device, means carried by each of said arm extremities in order to temporarily receive and retain said shuttle, means for transferring the shuttle from one arm extremity to the other each time said extremities are drawn closer together so as to ensure that the tying thread passes alternately above and beneath the layer of threads while passing through this latter, a knotter for knotting the tying thread, a cutting device for cutting-off that portion of the tying thread which is joined to the shuttle, and means for presenting to the means for gripping the typing thread which are carried by the shuttle the extremity of that portion of thread which is joined to the reserve bobbin.

In the French patent cited earlier, there was described one form of construction in which the means for transferring the shuttle from one arm extremity to the other each time said extremities are drawn closer together consist of a recess formed in the extremity of each arm for receiving the end portion of the shuttle, the recesses of the two arms being in oppositely-facing relation whilst the locking rod designed to move longitudinally within the interior of each arm is capable of retaining the shutter extremity which is engaged within the arm recess considered by reason of the fact that its corresponding extremity engages within a hollowed-out portion of said shuttle extremity.

The object of the invention is to perform this function of transfer of the shuttle from one arm to the other by making use of means which are more highly perfected.

To this end and in accordance with the invention, at least the extremities of the shuttle are of magnetic metal and each aforesaid extremity of the two arms is fitted with an electromagnet for temporarily receiving and retaining the corresponding extremity of the shuttle, said electromagnets being alternately energized through electric circuits comprising switches which are actuated in synchronism with the forward and backward movements of said arms.

By virtue of this device, it is possible to ensure very rapid transfer of the shuttle from one arm to the other and to maintain said shuttle in position in a very effective manner by making use of relatively simple means.

A better understanding of the invention will be obtained from the following description and from the accompanying drawings in which one embodiment of an improved tying device in accordance with the invention is shown by way of example but not in any limiting sense, and in which.

Figure 1:
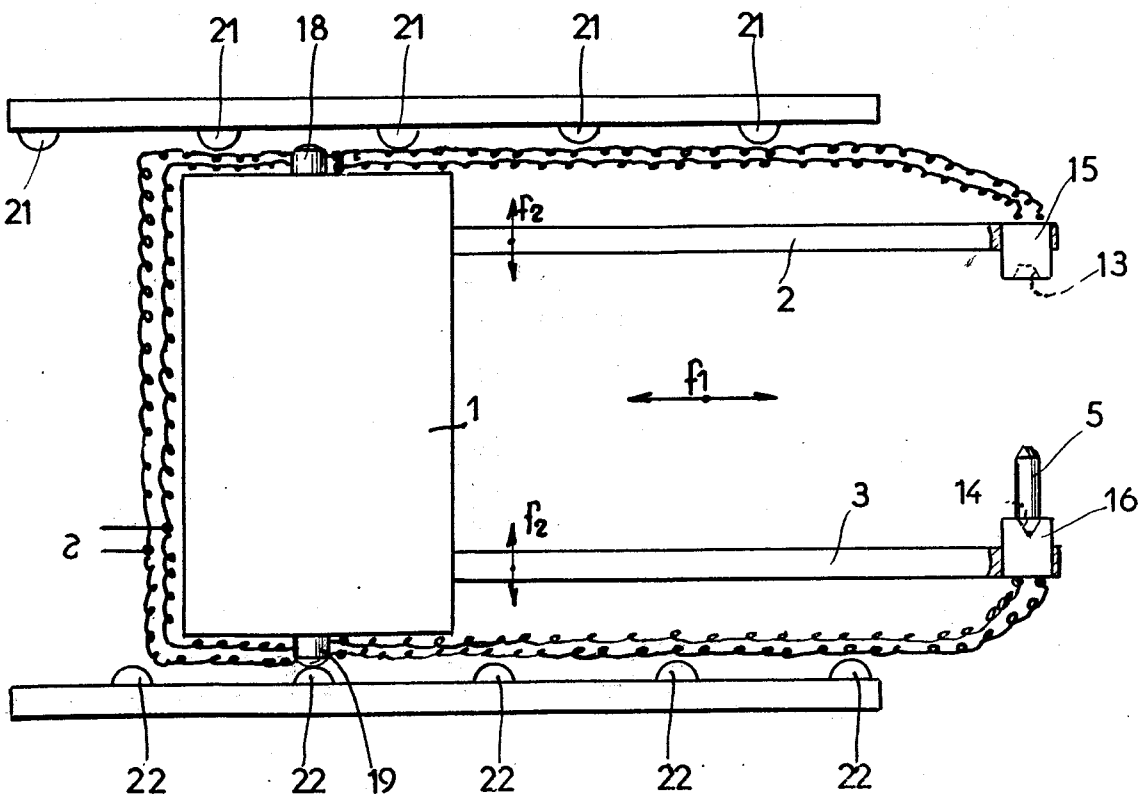
FIG. 1 is a profile view of the main portion of the head of a device for tying a layer of threads or slivers.

There is shown in FIG. 1 the main portion of the head of a device for tying a layer of threads or slivers of the type described and illustrated in the French patent Application aforementioned to which reference may be made for further details. This assembly comprises a carriage 1 which is capable of moving in the two directions indicated by the double arrow *f*1. There are mounted on the carriage 1 two parallel arms, namely an upper arm 2 and a lower arm 3 which are capable of moving vertically in the two directions of the double arrows *f*2 while always remaining in parallel relation in order to be capable of moving periodically towards and away from each other.

A shuttle 5 which is intended to pass a tying thread 6 (see also FIG. 2) between the strands such as 11-1, 11-2 of a hank can be gripped alternately by one of the two arms 2 and 3.

To this end, at least the two extremities of the shuttle 5 are of magnetic metal and have a frusto-conical shape. Said extremeties are capable of fitting without play within frusto-conical recesses 13-14 of corresponding shape, said recesses being formed in two electromagnets 15, 16 which are fixed respectively on the extremities of the two arms 2 and 3. Those faces of the two electromagnets 15 and 16 in which the recesses 13 and 14 are formed are located in oppositely-facing relation.

Each electromagnet 15 or 16 is connected electrically to a microswitch 18 or 19 which is fixed on the carriage 1. Stationary contact-studs 21, 22 for actuating the microswitches 18, 19 respectively are placed in staggered relation on the path of each microswitch. The two microswitches 18, 19 are connected to a suitable source of electric current designated by the reference F.

Figures 2, 3, 4, 5, 6, 7, 8, 9, 10, 11:
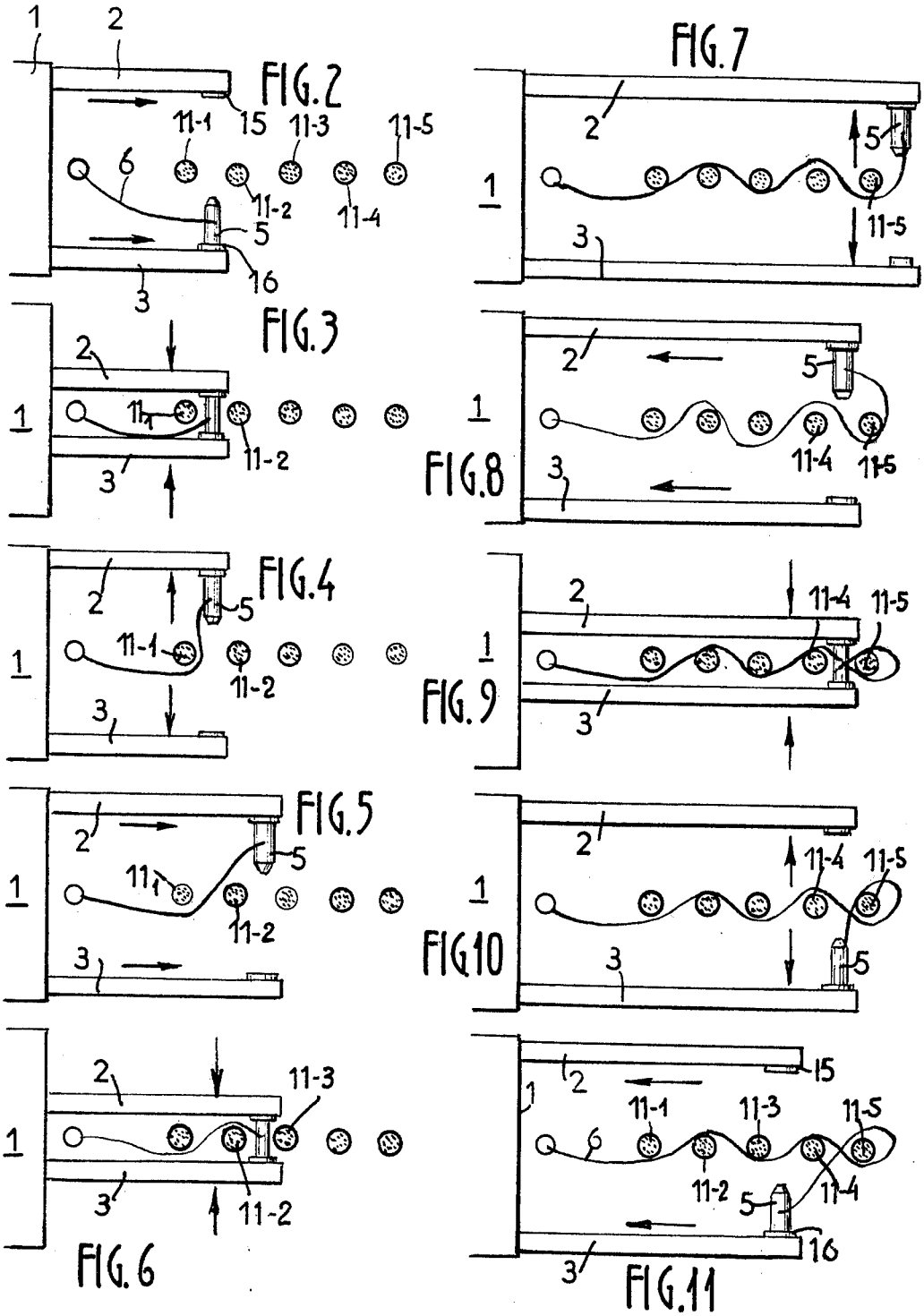
FIGS. 2 to 11 illustrate diagrammatically the operation of said device.

The operation is as follows:

In the example shown in FIGS. 2 to 11, a hank is divided into five bundles of threads designated respectively by the references 11-1, 11-2, 11-3, 11-4 and 11-5. The shuttle 5 in which the extremity of the tying thread 6 is gripped is carried for the moment by the lower arm 3 (FIG. 2), for example. The two arms 2, 3 advance simultaneously towards the hank, with the result that the shuttle 5 passes the tying thread 6 beneath the first bundle 11-1 of the threads of the hank (as shown in FIG. 2). The two arms 2, 3 move towards each other and, when the shuttle is located at an equal distance between the two bundles of threads 11-1 and 11-2, each shuttle extremity is engaged within the corresponding recess of the electromagnet 15 or 16 carried by the corresponding arm (FIG. 3). At this moment, the electromagnet 16 of the lower arm 3 is no longer energized since the microswitch 19 is no longer actuated by a contact-stud 22 whilst the electromagnet 15 of the upper arm 2 is energized as a result of the pressure exerted by a contact-stud 21 on the microswitch 18. The shuttle 5 is therefore now attached to the upper arm 2 and is no longer retained by the lower arm 3 (as shown in FIG. 4).

The two arms 2, 3 continue to advance while moving away from each other (as shown in FIG. 4) but the shuttle 5 is carried this time by the upper arm 2, with the result that the tying thread 6 passes above the second bundle 11-2 of threads of the hank (as shown in FIG. 5).

The two arms continue to advance while drawing closer together until the moment when the lower arm 3 again comes into contact with the shuttle 5 which is located half-way between the second bundle 11-2 and the third bundle 11-3 of threads of the hank (as shown in FIG. 6). There takes place a further transfer of attachment of the shuttle which is now carried by the lower arm by virtue of the fact that the electromagnet 16 is now energized whilst the electromagnet 15 is no longer energized.

As the movement continues, the tying thread is drawn beneath the third bundle 11-3 of threads of the hank, then over the fourth bundle 11-4 and then under the last bundle 11-5 as shown in FIG. 7. The two arms 2, 3 then begin to move backwards (as shown in FIG. 8) and the shuttle is alternately retained either by one arm or the other (FIGS. 9, 10, 11) until the tying thread has returned to a position above the first bundle of threads 11-1.

The shuttle changes-over from one arm to the other each time it passes within a space between two bundles of threads of the hank, with the result that the tying thread is drawn alternately above and beneath the succesive bundles of threads of the hank.

The tying thread is then knotted and cut in accordance with a process which does not form part of the present invention but a description of which can be found in the prior French patent cited earlier.

As can readily be understood, the invention is not limited to the form of construction described and illustrated in the accompanying drawings but, depending on the applications which are contemplated, can extend to many alternative forms within the capacity of those versed in the art without thereby departing either from the scope or the spirit of the invention.

I claim:

1. A device for tying a layer of threads or slivers as applicable in particular to the tying of hanks of textile threads on an automatic reeling frame having independent and movable heads, of the type which essentially comprises two arms whose extremities are capable of moving in the same plane on each side of the layer of threads to be tied while undergoing at the same time on the one hand a periodic movement towards and away from each other and on the other hand a forward movement followed by a movement of withdrawal, a shuttle provided with means for gripping the extremity of a tying thread supplied from a reserve bobbin carried by the device, means carried by each of said arm extremities in order to temporarily receive and retain said shuttle, and means for transferring the shuttle from one arm extremity to the other each time said extremities are drawn closer together so as to ensure that the tying thread passes alternately above and beneath the layer of threads while passing through said layer, wherein the means for transferring the shuttle from one arm extremity to the other consist in that the shuttle is of magnetic metal at least at the extremities thereof and each aforesaid extremity of the two arms is fitted with an electromagnet which constitutes said means for temporarily receiving and retaining the corresponding extremity of the shuttle, said electromagnets being energized alternately through electric circuits comprising switches which are actuated in synchronism with the forward and backward movements of said arms.

2. A device according to claim 1, wherein each of the two extremities of the shuttle is frusto-conical and each of the two electromagnets has a recess of corresponding frusto-conical shape for receiving the corresponding extremity of said shuttle.

3. A device according to claim 1, wherein each element is connected electrically to a microswitch which is made fast for translational motion with the corresponding arm and on the path of which are placed stationary contact-studs for actuating said microswitch.

* * * * *